US005775556A

United States Patent [19]

Brandow

[11] Patent Number: 5,775,556

[45] Date of Patent: Jul. 7, 1998

[54] OPENED SHOTGUN HOLSTER

[75] Inventor: Bruce L. Brandow, Mayville, N.Y.

[73] Assignee: Barbara J. Bennett, Westfield, N.Y.

[21] Appl. No.: 818,734

[22] Filed: Mar. 14, 1997

[51] Int. Cl.[6] ..... A45F 5/00

[52] U.S. Cl. ..... 224/270; 224/913; 224/242; D3/222

[58] Field of Search ..... 224/270, 272, 224/268, 676, 677, 678, 912, 913, 246, 247, 242; D3/222, 262; 211/64; 206/317

[56] References Cited

U.S. PATENT DOCUMENTS

| | | | |
|---|---|---|---|
| 1,469,258 | 10/1923 | Thompson | 224/913 |
| 2,574,143 | 11/1951 | Colby | 224/913 |
| 3,348,746 | 10/1967 | Stumpf | 224/270 |
| 3,501,074 | 3/1970 | Emerick | 224/913 |
| 3,664,558 | 5/1972 | Tolliver | 224/913 |
| 3,934,768 | 1/1976 | Jones | 224/913 |
| 5,029,741 | 7/1991 | Easter | 224/913 |

*Primary Examiner*—Henry J. Recla
*Assistant Examiner*—Gregory M. Vidovich
*Attorney, Agent, or Firm*—Frank J. Catalano; Scott R. Zingerman

[57] ABSTRACT

A holster supports a shotgun at the side of a shooter above the ground in an opened condition. A seat supports the shotgun and spaced side walls extend upwardly to receive the pivotally connected barrel and stock portions of the shotgun therebetween so as to prevent the shotgun from sliding laterally off the seat. A mounting device is provided on one of the side walls for mounting the holster proximate the waist of the shooter. The seat has a front section for supporting the barrel portion of the shotgun and a rear section for supporting the stock portion of the shotgun. The front and rear sections lie in intersecting planes which extend downwardly at an obtuse angle from their line of intersection to support the barrel and stock portions of the shotgun at approximately the obtuse angle defined by the planes. A pad preferably of leather protects the surface of the shotgun from being scratched or marred by the holster. The holster can preferably be formed of a single piece of flat metal stock or of molded plastic.

10 Claims, 3 Drawing Sheets

OPENED SHOTGUN HOLSTER

BACKGROUND OF THE INVENTION

This invention relates generally to sporting equipment and more particularly concerns equipment used in shooting trap, skeet or clay pigeons.

Trap, skeet and clay shooters take great pride in, and often spend considerable sums of money on, their shotguns. They are generally very uncomfortable about leaving their shotguns unattended and loathe to lay them on the ground or against any support that might scratch or damage them. At shooting stations, it is not uncommon to see shooters engaged in rather unique balancing acts, trying to support their shotgun while they adjust their hat, clean or wipe off their glasses or make any other adjustment requiring the use of both hands.

It is, therefore, an object of this invention to provide a shotgun holster which enables the shooter to carry a shotgun in its opened condition without the use of the shooter's hands. Another object of this invention is to provide a shotgun holster which will support an opened shotgun with minimal possibility of scratching or other damage to the surface of the shotgun.

SUMMARY OF THE INVENTION

A shotgun typically has its barrel and stock portions pivotally connected proximate its breach. The shotgun is manipulated between a closed or shooting condition in which the barrel and stock portions are in substantially straight alignment and an opened or safety condition in which the barrel and stock portions are in obtuse alignment. The holster of the present invention is used to support the shotgun in the opened condition at the side of a shooter above the ground. The holster has a seat which supports the shotgun. Side walls extend upwardly from the seat and are spaced to receive the pivotally connected barrel and stock portions therebetween so as to prevent the shotgun from sliding laterally off the seat. Means is provided on one of the side walls for mounting the holster proximate the waist of the shooter. The seat has a front section for supporting the barrel portion of the shotgun and a rear section for supporting the stock portion of the shotgun. The front and rear sections lie in intersecting planes which extend downwardly at an obtuse angle from their line of intersection to support the barrel and stock portions of the shotgun at approximately the obtuse angle defined by the planes.

Preferably, the mounting means is a tongue which downwardly depends from an upper end of and is spaced apart from and on an opposite side of its side wall as the shotgun. An item of clothing worn by the shooter, such as a belt or waistband, is received between the tongue and side wall to support the holster. In one embodiment, a spacer is disposed between the upper end of the tongue and the upper end of the side wall. At least one rivet fastens the tongue, the spacer and the side wall in laminar relationship. Alternatively, the seat and the side walls may be integrally formed.

In the preferred configuration of the holster, the seat is shaped as if formed from a single piece of flat stock having a vertical cut in its lower portion which defines front and rear sections of the flat stock. The front section of the flat stock is bent along a first line which extends downwardly at a first acute angle from approximately the upper end of the cut to form the front section of the seat. The rear section of the flat stock is bent along a second line which extends downwardly at a second acute angle from approximately the upper end of the cut to form the rear section of the seat. The side wall not attached to the tongue is shaped as if formed by bending the front section of the flat stock along a third line which extends below and approximately parallel to the first line to form a front portion of the side wall and bending the rear section of the stock along a fourth line which extends below and approximately parallel to the second line to form a rear portion of the side wall. This preferred configuration may be achieved by bending a piece of flat metal stock in the manner described or by molding plastic into the intended shape.

A pad may be disposed on those portions of the seat and side walls which would otherwise abut the barrel and stock portions of the shotgun to protect the surface of a shotgun seated on the holster. Preferably, the protective pad is formed of leather or like material.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
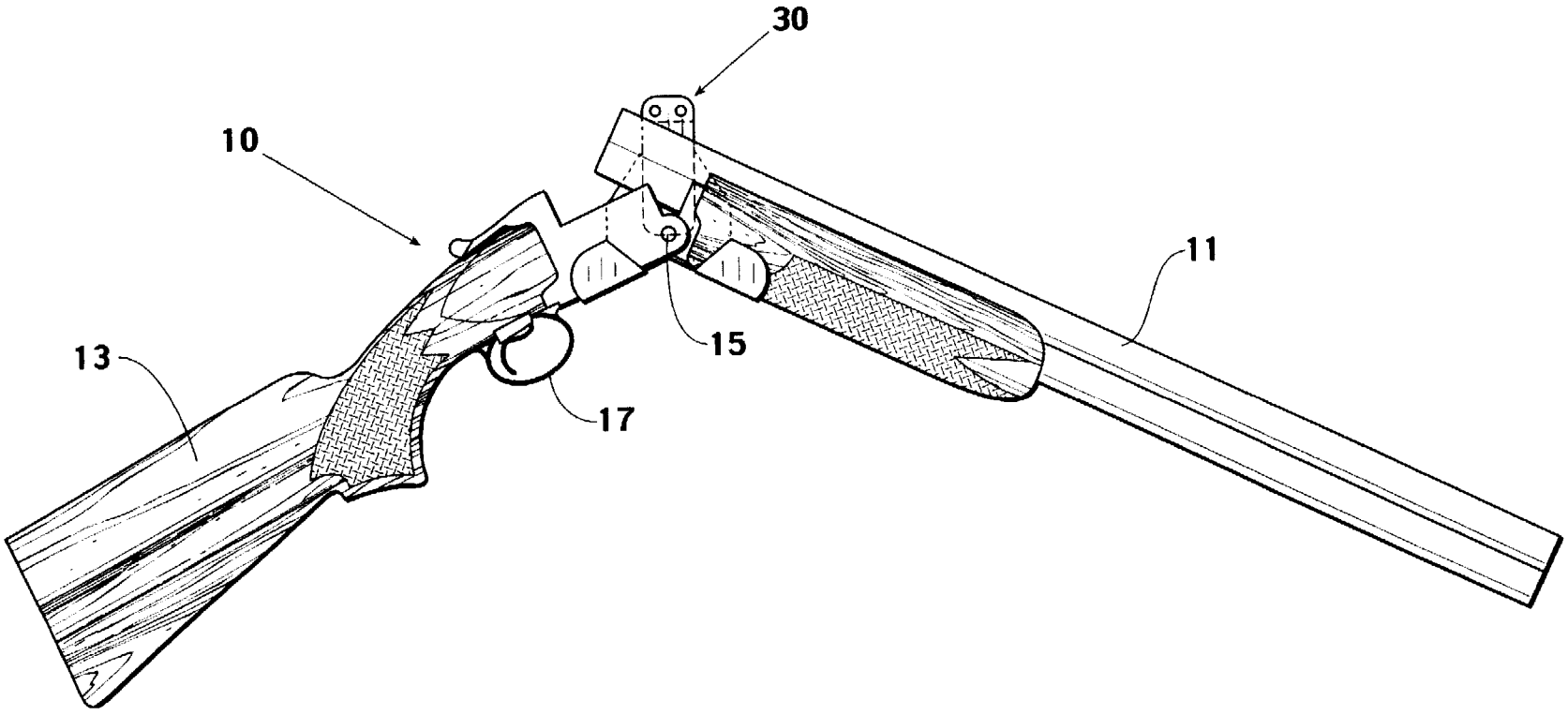
FIG. 1 is a side elevation view illustrating an opened shotgun seated on a holster.

Turning first to FIG. 1, a shotgun 10 is illustrated having a barrel portion 11 and a stock portion 13 pivotally connected proximate its breach 15. The pivot permits the shotgun 10 to be manipulated between a closed or shooting condition in which the barrel and stock portions 11 and 13 are in substantially straight alignment (not shown) and an opened or safety condition in which the barrel and stock portions 11 and 13 are in obtuse alignment, as shown. The shotgun 10 shown is typical of any known shotgun which breaks to its opened condition about a pivot 15 which is forward of the trigger guard 17 of the shotgun 10.

Figure 4:
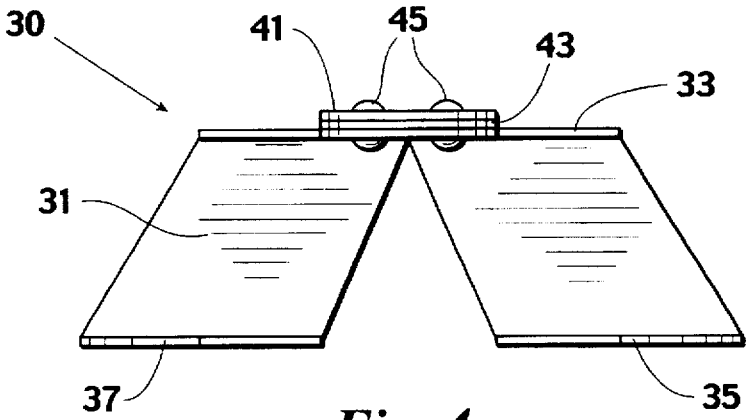
FIG. 4 is a top plan view of the holster of FIG. 2.
Figure 3:
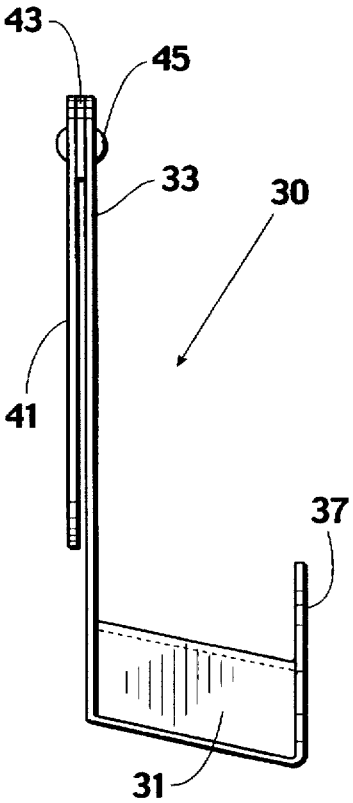
FIG. 3 is a rear elevation view of the holster of FIG. 2.
Figure 2:
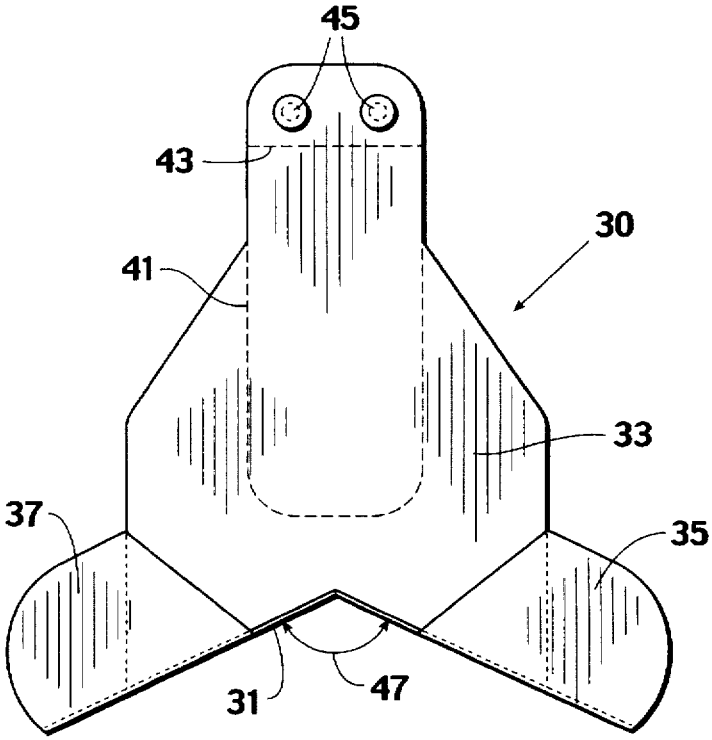
FIG. 2 is a side elevation view of a preferred embodiment of the holster.

The shotgun 10 is supported by a holster 30 which is shown in greater detail in FIGS. 2, 3 and 4. The holster 30 includes a seat 31 which supports the shotgun 10 above ground and sidewalls 33, 35 and 37 which extend upwardly from the seat 31 and are spaced to receive the pivotally connected barrel and stock portions 11 and 13 of the shotgun 10 therebetween so as to prevent the shotgun 10 from sliding laterally off the seat 31. Mounting means is connected to the upper end of one of the sidewalls 33 on one side of the shotgun 10 while the other sidewalls 35 and 37 extend upwardly on the opposite side of the shotgun 10. The mounting means is used to locate the holster in a position approximately at the waist of the shooter (not shown).

As shown, the mounting means preferably consists of a downwardly depending tongue 41 spaced apart from the sidewall 33 on the opposite side of the sidewall 33 as the seat 31. In the embodiment shown, a spacer 43 disposed between the upper end of the tongue 41 and the upper end of the sidewall 33 provides the necessary space between the tongue 41 and the sidewall 33 to permit insertion of an item of clothing, such as a belt or waistband worn by the shooter, to be inserted therebetween. The tongue 41, spacer 43 and sidewall 33 are fastened in laminar relationship by at least one and preferably two rivets 45. Alternatively, the mounting means may consist of substantially vertical slots in the side wall through which the shooter's belt can be fed.

A front section of the seat 31 supports the barrel portion 11 of the shotgun 10 and a rear section of the seat 31 supports the stock portion 13 of the shotgun 10. The front and rear sections of the seat 31 lie in intersecting planes which extend downwardly at an obtuse angle 47 from the line of intersection of the planes so as to support the barrel and stock portions 11 and 13 of the shotgun 10 at approximately the obtuse angle 47 of the planes. This is best seen in FIG. 1.

Figure 5:
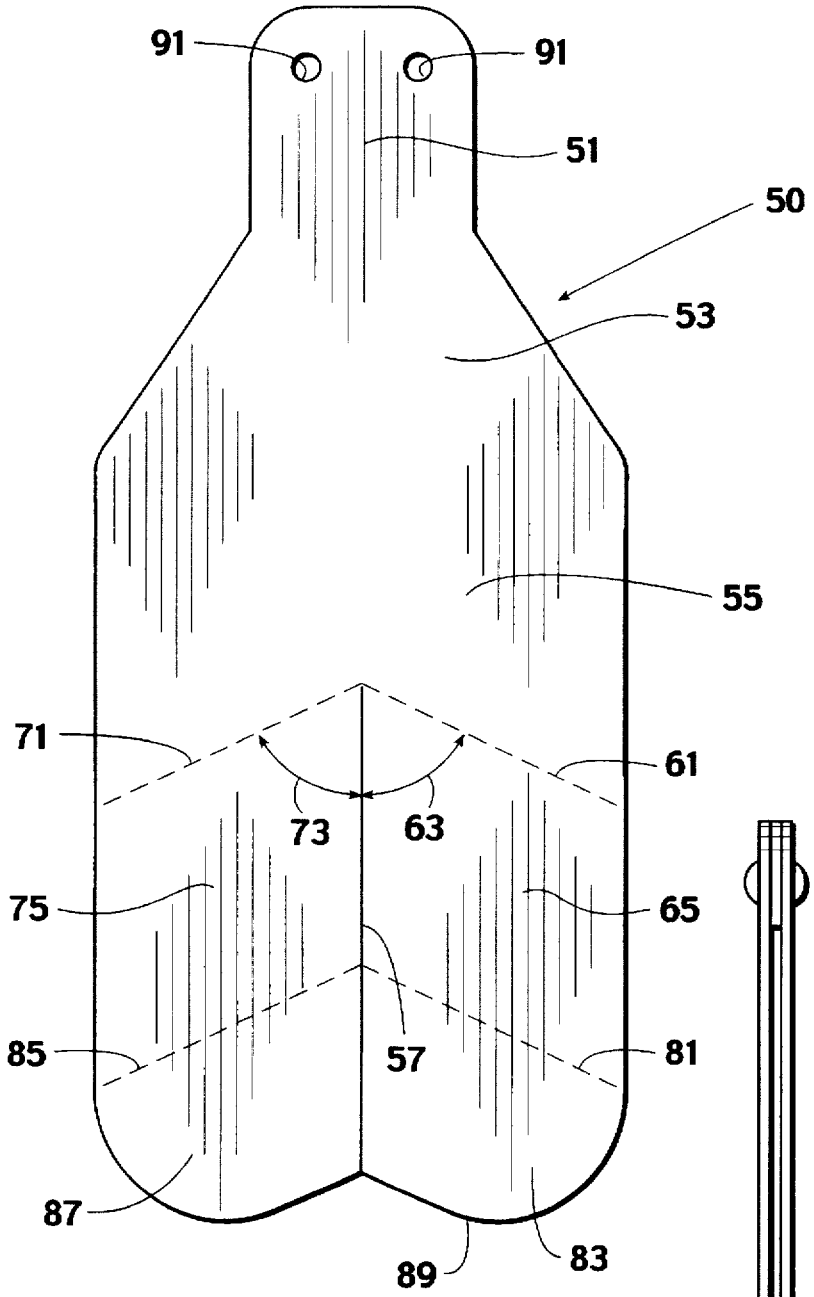
FIG. 5 is a top plan view of a piece of flat metal stock cut and marked for bending into the configuration of a holster.

The configuration of the holster 30 can be best understood by reference to FIG. 5 which illustrates a flat piece of metal stock 50 which can be used to form the holster 30. As shown, the flat stock 50 consists of a narrow upper portion 51, an outwardly tapering intermediate portion 53 and a wider lower portion 55. The lower portion is divided by a vertical cut 57. This lower portion is also marked for bending along a first line 61 which extends downwardly at a first acute angle 63 from approximately the upper end of the cut 57 to form a front section 65 of the holster seat. A second bend line 71 extends downwardly at a second acute angle 73 from approximately the upper end of the cut 57 to form a rear section 75 of the holster seat. A third bend line 81 which extends below and approximately parallel to the first line 61 defines a front portion 83 of the other holster sidewall and a fourth line 85 which extends below and approximately parallel to the second line 71 defines a rear portion 87 of the other sidewall of the holster. As shown, the bottom 89 of the flat stock 50 can be contoured to any desired configuration so long as the wall portions 83 and 87 are of sufficient dimension to maintain the shotgun 10 in its seated position on the holster. The narrow upper portion 51 of the flat stock 50 may also be provided with suitable holes 91 to receive the rivets 45 hereinbefore discussed.

Figure 6:
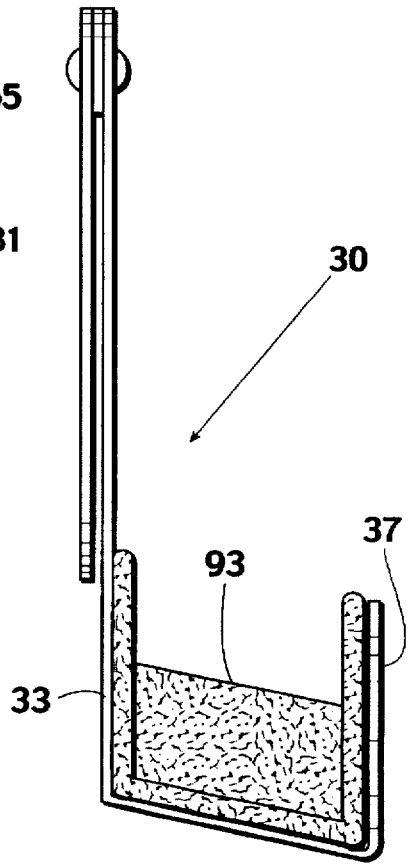
FIG. 6 is a rear elevation view of a holster with a protective pad mounted thereon.

Turning now to FIG. 6, the holster 30 illustrated is identical in all respects to the holster 30 shown in FIGS. 2, 3 and 4. However, to protect the surface of the shotgun 10, a protective pad 93, preferably formed of leather, is disposed on at least those portions of the seat 31 and sidewalls 33, 35 and 37 which may come in contact with the shotgun 10.

Preferably, the seat 31 and sidewalls 33, 35 and 37 are integrally formed. They may be formed by bending a piece of flat metal stock as illustrated in relation to FIG. 5 or they may be formed by injection molding plastic to the desired shape. They may be formed of metal, plastic or any other material suitable for the purpose and shaped by any known process.

Thus, it is apparent that there has been provided, in accordance with the invention, an opened shotgun holster that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use with a shotgun having a barrel portion and a stock portion pivotally connected to permit manipulation of the shotgun between a closed condition in which the portions are in substantially straight alignment and an opened condition in which the portions are in obtuse alignment, a holster for supporting the shotgun above the ground in the opened condition at the side of a shooter comprising a seat for supporting the shotgun, sidewalls extending upwardly from said seat and spaced to receive the pivotally connected barrel and stock portions therebetween so as to prevent the shotgun from sliding laterally off said seat and means on one of said side walls for mounting the holster proximate the waist of the shooter so as to support the shotgun above the ground, said seat having a front plate section for supporting the barrel portion of the shotgun and a rear plate section for supporting the stock portion of the shotgun, said front and rear plate sections of said seat lying in intersecting planes extending downwardly at an obtuse angle therebetween from a line of intersection thereof for supporting the barrel and stock portions of the shotgun at approximately said obtuse angle.

2. A holster according to claim 1, said mounting means comprising a tongue downwardly depending from an upper end of and spaced apart from said one of said side walls and on an opposite side thereof as the shotgun for receiving an item of clothing worn by the shooter between said tongue and said one of said sidewalls.

3. A holster according to claim 2 further comprising a spacer disposed between an upper end of said tongue and said upper end of said one of said side walls and at least one rivet fastening said upper end of said tongue, said spacer and said upper end of said one of said side walls in laminar relationship.

4. A holster according to claim 1, said seat and said side walls being integrally formed.

5. A holster according to claim 1, said seat being shaped as if formed from a single piece of flat stock having a vertical cut in a lower portion thereof defining front and rear sections of said flat stock, said front section of said flat stock being bent along a first line extending downwardly at a first acute angle from approximately an upper end of said cut to form said front plate section of said seat and said rear section of said flat stock being bent along a second line extending downwardly at a second acute angle from approximately said upper end of said cut to form said rear plate section of said seat, wherein said one side wall extends from said front and rear plate sections at said first and second lines, respectively.

6. A holster according to claim 5, said side wall opposite said one side wall being shaped as if formed from said front section of said stock being bent along a third line extending below and approximately parallel to said first line to form a front portion of said opposite side wall and said rear section of said stock being bent along a fourth line extending below and approximately parallel to said second line to form a rear portion of said opposite side wall.

7. A holster according to claim 6, said seat and said side walls being formed from a single piece of flat metal stock.

8. A holster according to claim 6, said seat and said side walls being molded.

9. A holster according to claim 1 further comprising a protective pad disposed on portions of said seat and said side walls which would otherwise abut the barrel and stock portions of a shotgun seated thereon and therebetween.

10. A holster according to claim 9, said protective pad being formed of leather.

* * * * *